United States Patent [19]

Weisbach

[11] Patent Number: 4,752,087

[45] Date of Patent: Jun. 21, 1988

[54] MEDICATION RECORDKEEPING INDICIA

[76] Inventor: Ruth Weisbach, 39 E. Schiller, Chicago, Ill. 60610

[21] Appl. No.: 908,246

[22] Filed: Sep. 17, 1986

[51] Int. Cl.[4] ..... B42D 15/00

[52] U.S. Cl. ..... 283/67; 283/900; 283/81; 206/459; 206/102

[58] Field of Search ..... 206/459, 534; 283/67, 283/79, 80, 81, 48 R, 102, 900

[56] References Cited

U.S. PATENT DOCUMENTS

| | | | |
|---|---|---|---|
| 2,179,168 | 11/1939 | Alexander | 283/102 X |
| 2,210,879 | 8/1940 | Cahoon, et al. | 283/102 X |
| 3,099,352 | 7/1963 | Auen | 206/459 X |
| 3,421,239 | 1/1969 | Smith | 283/81 X |
| 3,508,754 | 4/1970 | Shorin | 283/81 X |
| 4,165,709 | 8/1979 | Studer | 206/531 X |
| 4,191,376 | 3/1980 | Goldman, et al. | 283/102 X |
| 4,240,649 | 12/1980 | Weber | 283/102 X |
| 4,241,943 | 12/1980 | Malinovitz | 283/102 |
| 4,295,567 | 10/1981 | Knudsen | 206/459 X |
| 4,299,637 | 11/1981 | Oberdeck et al. | 283/102 X |
| 4,389,963 | 6/1983 | Pearson | 283/900 |
| 4,398,708 | 8/1983 | Goldman et al. | 283/102 X |
| 4,416,375 | 11/1983 | Braverman et al. | 206/459 X |
| 4,537,312 | 8/1985 | Intini | 206/531 |
| 4,540,175 | 9/1985 | Coppock | 283/102 X |
| 4,576,399 | 3/1986 | White et al. | 283/70 X |
| 4,634,149 | 1/1987 | Donovan | 283/81 X |

FOREIGN PATENT DOCUMENTS

| | | | |
|---|---|---|---|
| 2649645 | 5/1978 | Fed. Rep. of Germany | 283/48 R |
| 2904582 | 8/1980 | Fed. Rep. of Germany | 283/900 |
| 2250281 | 5/1975 | France | 283/900 |

*Primary Examiner*—Paul A. Bell

*Attorney, Agent, or Firm*—Ronald A. Sandler; Timothy T. Patula; Jerry A. Schulman

[57] ABSTRACT

A medication recordkeeping device comprised of a label or sheet with a plurality of characters identifying at least one subject upon which a friably removable mask covering obscures each of the characters. The label or sheet is adapted to be fixedly applied to a medication containing vessel wherein each time an individual unit of medication is consumed, the friable removable mask is removed from a character in order that the underlying subject will be exposed so that a visual recored will be kept of the medication consumed. The characters may be dates, numerals or dosage amounts corresponding to a patient's needs or the particular requirements of a medication.

1 Claim, 2 Drawing Sheets

MEDICATION RECORDKEEPING INDICIA

The present invention relates generally to a medication recordkeeping apparatus adapted for use in administering medication, and, in particular, to a medication recordkeeping apparatus, used with a medication-containing vessel, to visually record and indicate whether or not a dose of medication has been consumed.

BACKGROUND OF THE INVENTION

This invention relates to a device for accurately recording and visually indicating in a convenient and inexpensive manner the consumption of doses of a medication. Many patients, while ill, have difficulty remembering whether or not they have taken their medication and many times where the patient is unconscious, a health care professional must have some accurate means of identifying whether or not a particular medication has been consumed.

The principal object of the present invention is to provide a simple, inexpensive and accurate visual method of recording a patient's consumption of a medication in direct or close proximity to the medication containing vessel.

It is a further object of this invention to assist a patient who is consuming more than one medication by providing a physical recordkeeping device to prevent confusion as to which medications they have consumed. Additionally, for nurses and other health care providers caring for a large numer of patients, the present invention provides an accurate and easy method of medication recordkeeping administered to each patient.

A further object of this invention is to provide a medication recordkeeping device of inexpensive manufacture adaptable to many forms of medications as well as consumption occurrences and dosages as desired.

Numerous other advantages and features of the invention will become readily apparent from the detailed description of the preferred embodiment of the invention, from the claims, and from the accompanying drawings, in which like numerals are employed to designate like parts throughout the same.

SUMMARY OF THE INVENTION

The present invention comprises an inexpensive and accurate method for recording the consumption of a medication. In the preferred embodiment of the invention, the invention consists of an adhesively backed label embossed or printed with characters which are coated with a friably removable coating. The characters may be symbols referring to either numerals or letters which may represent dates, dosage amounts or occurances of consumption. The friable coating is removed from the label exposing the character or symbol beneath providing a permanent visual record of the medication consumed. Such a label may be placed upon the medication-containing vessel preferably on the side of the container opposite the prescription label.

In an alternative embodiment, the invention consists of a sheet instead of a label which is utilized in close proximity to the medication and patient. The sheet, like the label is comprised of characters and numerals masked by a friable removable coating which is removed upon consumption of medication.

The invention affords ready adaptability to any number of dosages to be administered to a patient. The invention is generally tamper proof, because once the coating is removed from the label or sheet exposing a character it may not be recoated. Additionally, manufacture is intended to be of an inexpensive nature such that the label may be readily applied to the medication containing vessel.

DESCRIPTION OF THE DRAWINGS

Further understanding of the foregoing may be had by reference to the accompanying drawings wherein.

DESCRIPTION OF THE PREFERRED EMBODIMENT OF THE INVENTION

Figure 1:
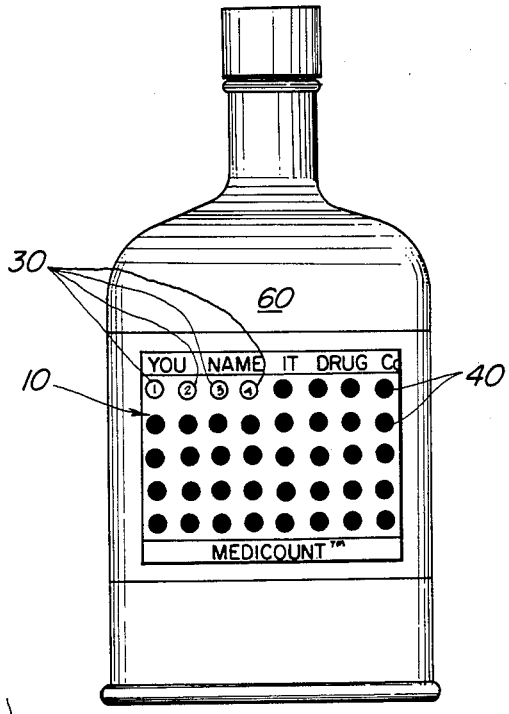
FIG. 1 is a perspective view of the present invention in the preferred embodiment.

While this invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

Referring now to FIG. 1, a perspective view of the present invention of the preferred embodiment is shown wherein a label 10 is adhesively affixed to a medicine bottle 60 in which four dosages have been consumed as indicated by the removal of the friable removable coating from the first four characters 30.

Figure 2:
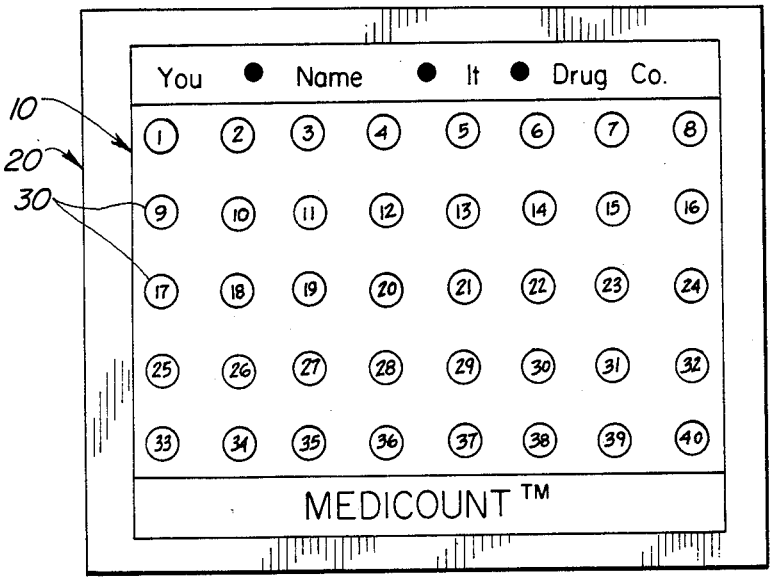
FIG. 2 is a front view of the present invention with the characters imprinted and without the friable removable coating.

FIG. 2 is a front view of the present invention with characters imprinted or embossed onto label 10 without the friable removable coating. This label or sheet may be coated in a conventional manner with a friable removable coating so that it may be readily applied to a medication containing vessel.

Figure 3:
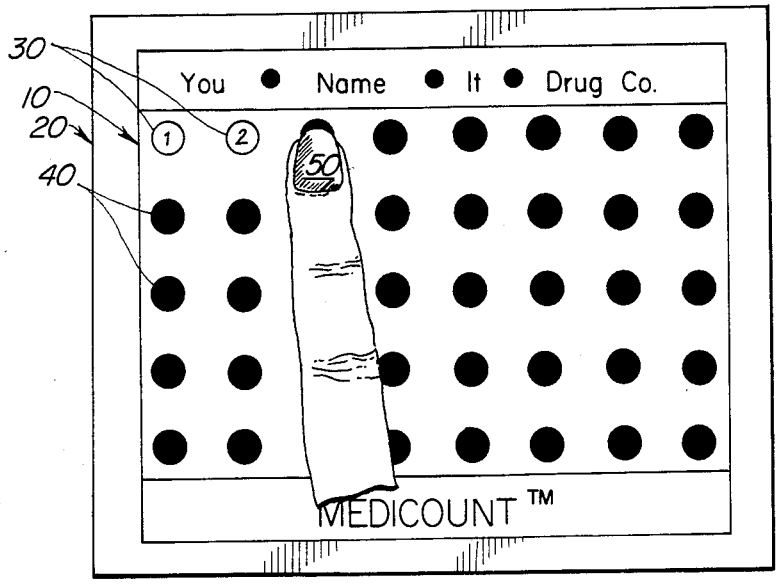
FIG. 3 is a front view of the present invention with the characters imprinted on a sheet and coated with a friable removable coating in which the first two characters are exposed and a third is about to be removed.

FIG. 3 is a front view of the present invention with characters imprinted or embossed upon sheet 10 coated with a friable removable coating in which an user is attempting to expose a third character signifying a consumption of a third dosage of medication. The conventional friable removable coating may be removed through the use of a coin, writing instrument or a dull edge of a fingernail.

Figure 4:
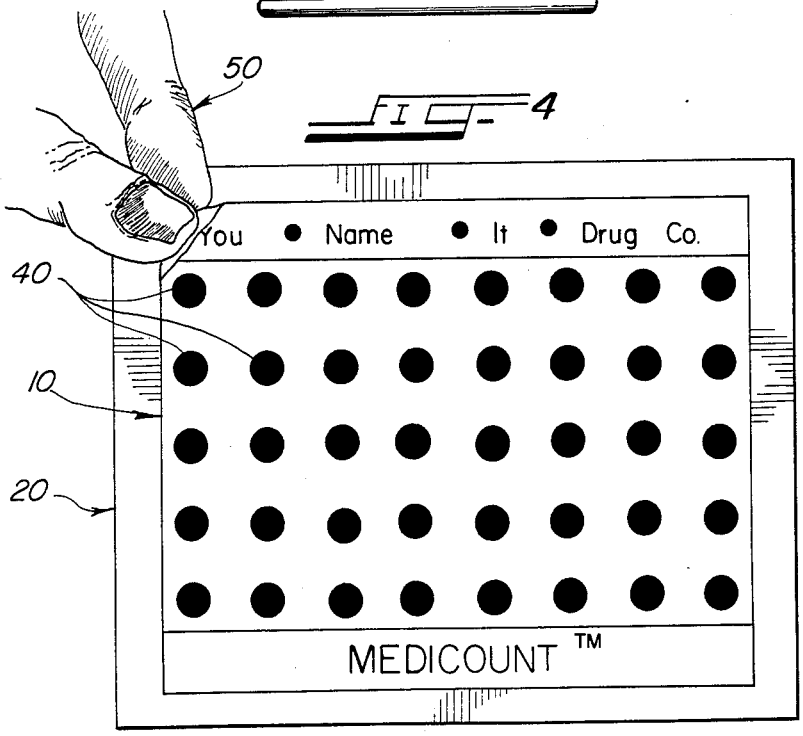
FIG. 4 is a front view of the present invention with the characters fully masked by the friable removable coating, in which the label is in the process of being removed from the protective backing to reveal the adhesive backside.

FIG. 4 is a front view of the present invention with characters 30 fully masked by the friable removable coating 40 on label 10 in which a user is preparing the label for application to a medication containing vessel such as a bottle as shown in FIG. 1 in which the label is peeled up and away from its backing to reveal adhesive backside for application to a vial.

In the preferred embodiment, a label, as shown in FIG. 4, is removed from its protective backing by peeling a corner upward and away from the backing and fixedly applying it to a medication containing vessel such as a vial or tube or as shown in FIG. 1, a bottle. A health care professional will select either the dates or frequency of occurances or the amount of dosages suggested for the medication and will remove the coating from the extra symbols or characters so as to individualize each label for a patient's needs so that when all characters are exposed on the label, the medication should be spent.

In an alternative embodiment, a sheet as shown in FIG. 3, imprinted or embossed with dates or frequency of occurances or dosage amounts in which the patient or health care professional administering the medication will remove the coating from the extra symbols or characters so as to likewise individualize each label for a patient's needs so that when all characters are exposed on the label, the medication should be spent.

The medication recordkeeping device in sheet form may also be utilized in conjunction with medication containing vessels such as tubes, bottles, or vials.

The method of accounting for the medication is comprised of the steps of applying the label to the medication containing vessel, with the label having a plurality of characters identifying at least one subject obscured by a friable removable mask. After one unit of medication from the medication containing vessel is consumed by a patient, the patient or other person removes the friable removable mask from a character on the label in order to expose the underlying character so that a visual record is kept of the medication consumed.

FIG. 1 is a perspective view of the present invention shown in the preferred embodiment. Namely, the medical recordkeeping indicia label 10 applied to a medication containing vessel 60 in which characters 30, shown generally, are exposed on label 10. A friable removable coating 40 is shown coating the majority of characters 30 on label 10.

FIG. 2 is a front view of the present invention embodied as a label 10 disposed on sheet 20 in which characters 30 shown generally are embossed or printed upon said label 10. The friable removable coating as shown in the accompanying figures is not shown in FIG. 2.

FIG. 3 is a front view of the present invention embodied on a label 10 and sheet 20 in which characters 30 are embossed or printed on label 10. A friable removable coating 40 is shown generally covering the majority of the characters 30. A fingertip or fingernail 50 is shown removing the friable removable coating 40 from character 30. The friable removable coating 30 is removed from the first two characters identifying the numerals 1 and 2 in which a third character is in the process of having the coating removed by fingertip 50. The remaining characters 30 are coated with a friable removable coating 40. FIG. 3 may also depict an alternative embodiment in which label 10 is not removed from sheet 20 and is used in proximity to a medication-containing vessel but is not attached thereto.

FIG. 4 is a front view of the present invention shown as a label 10 fixedly adhered to sheet or backing 20 in which characters 30 are entirely masked by friable removable coating 40. Fingertips 50 are in the process of removing label 10 from backing sheet 20 in order that label 10 be removed from sheet 20 to be placed and adhered to on a medication containing vessel 60 as shown in FIG. 1.

The operation of the present invention is simply and effectively described as follows. Label 10 is affixed on a removable protective sheet or backing 20 as shown in FIG. 4 in which the characters 30 printed or embossed thereon are coated with a friable removable coating 40 by peeling up a corner of said label 10 and applying it to the medication containing vessel 60.

As medication is consumed, a fingertip 50, as shown in FIG. 3, or a edge of a coin or other device is used to remove the friable removable coating 40 to reveal the character 30 contained beneath. FIG. 1 illustrates the friable coating 40 being removed from the fourth character 30 signifying the consumption of fourth dosage or occurrence of the medication contained within the bottle or vessel 60.

Furthermore, the present invention may be embodied by a label 10 affixedly adhere to sheet 20 and likewise, characters 30 are revealed after the medication is consumed and the coating 40 is removed, resulting in a permanent record of the medication consumed by the patient.

It should be noted that label 10 may have any number or type of characters, symbols or dosage amounts therein as may suit the prescribed needs of the patient or the particularities of the medication being consumed. Additionally, the friable removable coating 40 may be removed from the higher occurrence or dosage numbers for medication in advance so as to limit the maximum number of dosages a patient should consume. This would give the patient an awareness that only a fixed number of dosages are needed and when the patient should discontinue the medication or to obtain an additional supply of medication.

In the foregoing specification describes only the preferred embodiment of the invention as shown. Other embodiments may be articulated as well. The terms and expressions therefore serve only to describe the invention by example only and not to limit the invention. It is expected that others will perceive differences which while differing from the foregoing, do not depart from the spirit and scope of the invention herein described and claimed.

What I claim:

1. A method of recordkeeping for medication, comprising the steps of:

imprinting a label with a plurality of characters obscured by friably removable mask;

fixedly applying said label to a medication-containing vessel;

consuming a unit of medication from said medication-containing vessel; and removing at least one said friable mask from said label in order to expose one or more of said characters to create a visual record of the medication consumed.

* * * * *